United States Patent [19]

Stemke

[11] 4,436,649

[45] Mar. 13, 1984

[54] GREASE COMPOSITION WITH IMPROVED LOW SHEAR STABILITY

[75] Inventor: Jeffrey E. Stemke, Petaluma, Calif.

[73] Assignee: Chevron Research Company, San Francisco, Calif.

[21] Appl. No.: 393,904

[22] Filed: Jun. 30, 1982

[51] Int. Cl.[3] ..... C10M 5/20

[52] U.S. Cl. ..... 252/51.5 A; 252/25

[58] Field of Search ..... 252/51.5 A, 25

[56] References Cited

U.S. PATENT DOCUMENTS

| | | | |
|---|---|---|---|
| 4,022,700 | 5/1977 | Harris | 252/51.5 A |
| 4,115,284 | 9/1978 | Kinoshita et al. | 252/51.5 A |
| 4,340,104 | 7/1982 | Kuan | 252/51.5 A |

*Primary Examiner*—Jacqueline V. Howard

*Attorney, Agent, or Firm*—D. A. Newell; J. M. Whitney; J. J. DeYoung

[57] ABSTRACT

Disclosed is a polyurea-thickened grease containing a polyhydroxylated compound which improves the low shear stability of the grease.

6 Claims, No Drawings

GREASE COMPOSITION WITH IMPROVED LOW SHEAR STABILITY

BACKGROUND OF THE INVENTION

The requirement that grease compositions provide adequate lubrication at high temperature for extended periods of time has become increasingly important. For this reason, grease compositions containing a variety of organic thickening agents, such as those containing multiple uriedo or urea functional groups, have been developed. For example, U.S. Pat. Nos. 3,242,210, 3,243,372, and 3,401,027 disclose polyurea grease thickeners obtained by reacting a three-component reactant mixture comprising a monoamine, a diamine and a diisocyanate, or a monoisocyanate, a diisocyanate and a diamine. As a general rule, the reaction product is comprised of a mixture of urea-containing species of varying chain length and urea content. However, by careful control of reaction variables such as, e.g., the relative quantities of reactants employed, the reaction temperature and the rate and order of reactant mixing, a product may normally be obtained which predominates in one polyurea species. The polyurea reaction is preferably carried out in situ in the grease carrier, and the reaction product may be utilized directly as a grease thickener.

While greases thickened with polyurea thickeners are in many respects superior to older lubricants in severe service application, especially with regard to maintenance of grease consistency at high temperatures, such greases suffer several disadvantages which limit their usefulness under practical service conditions. For example, while polyurea-thickened greases show excellent retention of mechanical properties at high temperature (70° C. or above) and high shear, they tend to soften considerably when subjected to low shear. In fact, the tendency to soften under low shear can be so great that the grease can, when subject to mechanical working under these conditions, undergo a change in penetration grade, e.g., from a No. 2 NLGI penetration grade to a No. 1 NLGI penetration grade. This change in penetration grade under low shear is particularly troublesome since it may occur under practical use conditions when the grease is transferred from the original shipping container or is otherwise stirred or handled. Consequently, normal handling of the grease in making it available to the ultimate consumer may change its consistency to such extent that it is no longer the desired penetration grade for the intended application. While it is true that the change in consistency is reversible in that the softened grease can be subjected to high shear to return the grease to its original consistency, this reversal often requires that the softened grease be shipped back to the formulator for reprocessing.

DESCRIPTION OF THE PRIOR ART

Disclosed in U.S. Pat. No. 4,104,177 and 4,111,822 are polyurea-thickened greases containing certain acylated alkylene polyamines of the formula:

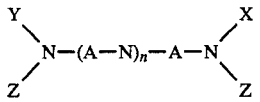

wherein A is alkylene of 2 to 4 carbon atoms and n is an integer of from 0 to 3; X is H or Z; Y is selected from H, alkyl containing 12 to 22 carbon atoms; and Z is an acyl group. These additives are disclosed as providing improved ambient temperature mechanical stability and improved rust protection in polyurea-thickened greases.

SUMMARY OF THE INVENTION

A grease composition comprising a major amount of a lubricating oil base vehicle, a polyurea gellant in an amount sufficient to thicken the base vehicle to a grease consistency, and a minor amount of a polyhydroxylated compound.

DETAILED DESCRIPTION OF THE INVENTION

The grease composition of the present invention comprises the combination of at least three components: (1) a lubricating oil base vehicle, (2) a polyurea gellant, and (3) a polyhydroxylated compound. Other additives can also be present but only the above three are absolutely essential.

The lubricating oil base vehicle and the polyurea gellant are well known in the art. Any lubricating oil base vehicle commonly used in greases can be used. Generally, the base vehicle will comprise 50 to 99 weight percent of the final grease composition. The base vehicles are most commonly petroleum oils or synthetic base oils.

The polyurea gellant component for use in the present combination is also well known in the grease art and may be prepared by conventional means. For example, U.S. Pat. No. 3,242,210 describes the preparation of polyurea-thickened greases suitable for use in the combination of the present invention, and its disclosure is incorporated herein by reference. The polyurea is used in an amount sufficient to thicken the base vehicle to grease consistency. When used as a gellant, the polyureas are normally present in an amount of at least about 0.5 weight percent and more usually from about 1 to 25 or more weight percent.

The third essential component in the grease of the present invention is a polyhydroxylated compound. Generally, the polyhydroxylated compounds useful in the present invention will have molecular weights less than 1,000 and preferably in the range of 100 to 999.

Addition of the polyhydroxylated compound to the polyurea-thickened grease composition significantly improves the low shear stability of the composition. Why the polyhydroxylated compounds improve the low shear stability of polyurea-thickened greases is not completely understood. However, it is believed that hydrogen-bonding interactions between the polyurea molecules or fibers and the polyhydroxylated compounds may account for the improvement in the low shear stability. Thus, it is preferred to use polyhydroxylated compounds which are capable of hydrogen-bonding interactions with the polyurea molecules. Generally, these polyhydroxylated compounds will have a pKa value greater than 5.0 and preferably greater than 7.0. "pKa" refers to the negative logarithm of the acid equilibrium constant which is well known in the art. Such polyhydroxylated compounds will be characterized by the presence of hydrogen-bond donor groups and/or hydrogen-bond acceptor groups.

Polyhydroxylated compounds useful in the present invention will contain 2 to 25 or more hydroxyl groups and preferably 2 to 6 hydroxyl groups per molecule. Preferably, the compounds will contain at least 1 carbon atom per hydroxyl group.

Examples of polyols suitable for purposes of the present invention are: ethylene glycol, propylene glycol, triethylene glycol, polyethylene glycol, glycerol, erythritol, pentaerythritol, dipentaerythritol, polypentaerythritols, trimethylol propane, arabitol, xylitol, adonitol, sorbitol, sorbitan (partially dehydrated sorbitol), mannitol, and the like.

Polyhydroxylated esters are also suitable for purposes of this invention, particularly the esters of long-chain fatty acids that contain at least 8, and preferably 12 to 24 carbon atoms per molecule. Examples of fatty acids that form suitable esters for the purposes of this invention are caprylic acid, capric acid, lauric acid, myristic acid, palmitic acid, stearic acid, oleic acid, linoleic acid, linolenic acid, arachidic acid, behenic acid, and lignoceric acid. Specific examples of the esters that can be used in the compositions of this invention are glycerol monolaurate, glycerol monopalmitate, glycerol monostearate, glycerol monooleate, erythritol monolaurate, erythritol monopalmitate, erythritol monostearate, erythritol monooleate, erythritol dioleate, erythritan monolaurate, erythritan monooleate, arabitol monolaurate, arabitol monooleate, arabitan monolaurate, arabitan monooleate, sorbitol monolaurate, sorbitol dilaurate, sorbitol monooleate, sorbitol trioleate, sorbitol tetraoleate, sorbitan monolaurate, sorbitan monopalmitate, sorbitan monostearate, sorbitan monooleate, sorbitan dilaurate, sorbitan trioleate, and commercially available mixtures of such esters. A particularly preferred ester is pentaerythritol monooleate.

A minor but effective amount of the polyhydroxylated compound is added to improve the low shear stability of the polyurea-thickened grease. Generally, from 0.1 to 20 weight percent or more of the final grease composition will comprise the polyhydroxylated compound and preferably 1 to 10 weight percent and most preferably 2 to 6 weight percent.

In order to demonstrate the invention more fully, reference is made to the following examples.

EXAMPLES

Examples 1 and 2

A polyurea-thickened grease was prepared using conventional processing as in accordance with the teaching of U.S. Pat. No. 3,242,210 from the reaction of oleylamine, ethylene diamine, and toluene diisocyanate. A polyhydroxylated compound, pentaerythritol monooleate, was blended into the grease to a concentration of 5.0 weight percent.

The low shear stability of the polyurea-thickened grease with and without the pentaerythritol monooleate was tested by measuring the percent softening using the Shell Roll Test (ASTM D-1831). The improvement in low shear stability is demonstrated by a lower percent softening. The polyurea-thickened grease with 5.0 weight percent pentaerythritol monooleate softened 1.5 percent in the Shell Roll Test, while the polyurea-thickened grease alone softened 14.3 percent.

Example 3

Prior Art

A polyurea grease containing an acylated alkylene amine, specifically additive A in U.S. Pat. No. 4,104,177, was prepared. The additive was prepared according to the procedure specified in the patent from the reaction of Duomeen T and oleic acid at 190° C. The additive was tested for low shear stability at a concentration of 5 weight percent in the same polyurea-containing base grease as used in Examples 1 and 2. The grease softened 12.1 percent in the Shell Roll Test (ASTM D-1831).

As will be appreciated by those skilled in the art, comparison of Examples 1 and 2 demonstrates the effectiveness of the polyhydroxylated compounds of the present invention in improving the low shear stability of polyurea-thickened greases.

Comparison of Examples 1 and 2 with Example 3 further indicates that the polyhydroxylated compounds of the present invention are superior to the acylated alkylene amine of U.S. Pat. No. 4,104,177 in improving low shear stability of the grease.

What is claimed is:

1. A grease composition comprising a major amount of a lubricating oil base vehicle, a polyurea gellant in an amount sufficient to thicken the base vehicle to a grease consistency, and from 0.1 to 20 weight percent of a polyhydroxylated compound.

2. The grease composition of claim 1 wherein said polyhydroxylated compound has a molecular weight of less than 1,000.

3. The grease composition of claim 2 wherein said grease contains 1.0 to 10.0 weight percent of said polyhydroxylated compound and said polyhydroxylated compound contains 2 to 25 hydroxyl groups per molecule.

4. The grease composition of claim 3 wherein said polyhydroxylated compound has a molecular weight in the range of 100 to 999, and contains 2 to 6 hydroxyl groups per molecule.

5. The grease composition of claim 4 wherein said polyhydroxylated compound is a polyhydroxylated ester.

6. The grease composition of claim 5 wherein said ester is pentaerythritol monooleate.

* * * * *